US006652055B2

(12) United States Patent
Oikawa

(10) Patent No.: US 6,652,055 B2
(45) Date of Patent: Nov. 25, 2003

(54) INK JET PRINTING APPARATUS AND INK JET PRINTING METHOD

(75) Inventor: Masaki Oikawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/963,447

(22) Filed: Sep. 27, 2001

(65) Prior Publication Data

US 2002/0039117 A1 Apr. 4, 2002

(30) Foreign Application Priority Data

Sep. 29, 2000 (JP) ..... 2000-301096

(51) Int. Cl.[7] ..... B41J 29/38
(52) U.S. Cl. ..... 347/9; 347/11; 347/14
(58) Field of Search ..... 347/9, 11, 14

(56) References Cited

U.S. PATENT DOCUMENTS

| | | | | |
|---|---|---|---|---|
| 5,036,337 A | | 7/1991 | Rezanka | 346/1.1 |
| 5,497,174 A | | 3/1996 | Stephany et al. | 347/13 |
| 5,677,577 A | * | 10/1997 | Barbeheim et al. | 307/98 |
| 5,975,667 A | | 11/1999 | Moriguchi et al. | 347/10 |
| 6,116,714 A | | 9/2000 | Imanaka et al. | 347/19 |
| 6,331,039 B1 | * | 12/2001 | Iwasaki et al. | 347/11 |
| 6,382,755 B1 | * | 5/2002 | Imanaka et al. | 347/12 |
| 6,447,085 B1 | | 9/2002 | Yagi et al. | 347/9 |

FOREIGN PATENT DOCUMENTS

| | | | |
|---|---|---|---|
| EP | 0 626 261 A2 | 5/1994 | |
| EP | 0 703 079 A2 | 8/1995 | |
| EP | 0 709 196 A2 | 10/1995 | |
| EP | 0 750 988 A2 | 6/1996 | |
| EP | 1 033 249 A1 | 9/2000 | |
| EP | 1 078 750 A2 | 2/2001 | |
| JP | 9-11504 | 1/1997 | B41J/2/205 |

* cited by examiner

*Primary Examiner*—Benjamin R. Fuller
*Assistant Examiner*—Alfred Dudding
(74) *Attorney, Agent, or Firm*—Fitzpatrick, Cella, Harper & Scinto

(57) ABSTRACT

When a plurality of heaters in the printing head are driven and the pulse width is controlled according to a change in the voltage drop corresponding to the number of driven heaters, the control range of the pulse width is properly determined to ensure a stable ink ejection. More specifically, the driving bit number for each block representing the number of heaters to be driven is counted; and based on this count value, a table is referenced to determine the pulse width of a single pulse. Then, in an inappropriate range of pulse width where the ink ejection amount varies largely, the single pulse is changed into a double pulse by referencing the table with the pulse width to obtain a double pulse driving waveform.

42 Claims, 15 Drawing Sheets

| | DECODER INPUT | | | | DECODER OUTPUT | | | | | | | | | | |
|---|---|---|---|---|---|---|---|---|---|---|---|---|---|---|---|
| CODE | BE 3 | BE 2 | BE 1 | BE 0 | BLE 15 | BLE 14 | BLE 13 | BLE 12 | BLE 11 | ····· | BLE 4 | BLE 3 | BLE 2 | BLE 1 | BLE 0 |
| 0 | L | L | L | L | L | L | L | L | L | ····· | L | L | L | L | H |
| 1 | L | L | L | H | L | L | L | L | L | ····· | L | L | L | H | L |
| 2 | L | L | H | L | L | L | L | L | L | ····· | L | L | H | L | L |
| 3 | L | L | H | H | L | L | L | L | L | ····· | L | H | L | L | L |
| 4 | L | H | L | L | L | L | L | L | L | ····· | H | L | L | L | L |
| ⋮ | ⋮ | ⋮ | ⋮ | ⋮ | ⋮ | ⋮ | ⋮ | ⋮ | ⋮ | | ⋮ | ⋮ | ⋮ | ⋮ | ⋮ |
| 11 | H | L | H | H | L | L | L | L | H | ····· | L | L | L | L | L |
| 12 | H | H | L | L | L | L | L | H | L | ····· | L | L | L | L | L |
| 13 | H | H | L | H | L | L | H | L | L | ····· | L | L | L | L | L |
| 14 | H | H | H | L | L | H | L | L | L | ····· | L | L | L | L | L |
| 15 | H | H | H | H | H | L | L | L | L | ····· | L | L | L | L | L |

SIMULTANEOULY DRIVEN
BIT-DRIVE PULSE TABLE

| SIMULTANEOUS DRIVE BIT NUMBER | 0~3 | 4~7 | 8~11 | 12~15 | 16~19 | 20~24 |
|---|---|---|---|---|---|---|
| CONDUCTION TIME [μs] | 1.60 | 1.80 | 2.00 | 2.50 | 3.00 | 3.60 |

FIG.11

DRIVE PULSE WIDTH DIVISION TABLE

| PULSE WIDTH | 1.60 | 1.80 | 2.00 | 2.50 | 3.00 | 3.60 |
|---|---|---|---|---|---|---|
| P1 [μs] | 0.70 | 0.50 | 0.40 | 0.30 | 0.20 | 0.00 |
| P2 [μs] | 0.90 | 0.80 | 0.70 | 0.60 | 0.50 | 0.00 |
| P3 [μs] | 0.90 | 1.30 | 1.60 | 2.20 | 2.80 | 3.60 |

FIG.12

HEATER RESISTANCE-DRIVE PULSE TABLE

| TOTAL RESISTANCE [Ω] | 80~89 | 89~99 | 100~109 | 110~119 | 120~129 | 130~139 |
|---|---|---|---|---|---|---|
| CONDUCTION TIME [μs] | 1.60 | 1.80 | 2.00 | 2.50 | 3.00 | 3.60 |

FIG.15

INK JET PRINTING APPARATUS AND INK JET PRINTING METHOD

This application is based on Patent Application No. 2000-301096 filed Sep. 29, 2000 in Japan, the content of which is incorporated hereinto by reference.

BACKGROUND OF THE INVENTION

1. Field of the Invention

The present invention relates to an ink jet printing apparatus and in ink jet printing method, and more particularly to a system of driving an electrothermal transducer to apply thermal energy to ink so as to generate a bubble and, by a pressure of the bubble, eject an ink droplet.

2. Description of the Related Art

Printing apparatus represented by printers have been in wide use in recent years. There has been a growing demand for such printing apparatus to have capabilities of faster printing speed, higher print resolution and lower noise. Among printing apparatus that meet such requirements is an ink jet printing apparatus. The ink jet printing system is a system that ejects ink droplets (printing liquid) from ejection openings of a printing head onto a printing medium and cause the ejected ink droplets to be deposited on the printing medium to perform printing. This system can realize the fast printing and other features described above relatively easily and, because the printing is done without contact between the printing head and the printing medium, fixing of ink to the printing medium is not disturbed thus assuring the printing of a relatively stable image.

Of the ink jet printing systems, a system that uses thermal energy generated by the electrothermal transducer to eject ink is widely used. This system generates thermal energy by applying a driving signal of a predetermined voltage across an electrothermal transducer (hereinafter referred to also as a "heater").

Heaters and wiring electrodes for applying voltage to the heaters are fabricated on a substrate by using the same technology as used in the semiconductor manufacturing process, and from this substrate, a printing head is made. Heating resistor films each forming the individual heater provided in each ejection opening of the printing head, for example, have variations in manufacturing of the heating resistor, which in turn may cause variations in the resistance values. Hence, even when the same voltages of signals are applied to the heaters of the printing head, the resistance variations result in current variations among heaters. This in turn causes variations in the thermal energy generated and therefore some ejection openings may fail to eject ink properly. Further, even when there are no variations among the heaters in one printing head, there may be variations among different printing heads.

To deal with this problem, a conventional practice adopted in the manufacturing process involves measuring resistance values of a plurality of heaters in the printing head in advance and, based on the resistance measurements, setting pulse widths of driving pulses applied to individual heaters. Furthermore, the pulse widths are determined by taking into account the resistances of wiring electrodes as well as the heater resistances.

Regarding the driving of a multi-nozzle head having a plurality of ejection openings (hereinafter referred to also as "nozzles"), a so-called time-division driving (or block driving) is known. A simplest control method of printing a line along a direction in which the nozzles are arranged is to simultaneously eject ink from all the nozzles of the printing head. When the printing head has a large number of nozzles for fast printing and high print resolution, however, simultaneous driving of all the nozzles of the printing head may cause a significant voltage drop or create a temporary large negative pressure in a common liquid chamber making it difficult to refill ink into individual nozzles as quickly as required. To deal with this problem, the time-division driving system is often employed whereby a plurality of nozzles in the printing head are divided into several blocks and the driving of the printing head is performed for each block on a time-division basis. With this time-division driving system, ink dots form by ink droplets ejected from the one block of nozzles have some positional deviation from ink dots formed by other block of nozzles. This deviation is made as indistinguishable as possible by adjusting the positions of the nozzles in the printing head or by tilting columns of nozzles.

The number of nozzles of the printing head may be set to as large as several hundred or several thousand nozzles and the heater driving frequency may be set to several tens of kHz so as to meet further demands for faster printing and higher resolution. In that case, the number of heaters that need to be driven simultaneously in each block increases and thus an instantaneous maximum current also increases, further increasing the drop in the power supply voltage due to wiring electrodes. Although the number of heaters driven simultaneously changes according to print data, when the number of heaters in each block is large as described above, the relatively large voltage drop prevents individual heaters from being supplied a required voltage for ink ejection, thus resulting in an ink ejection failure such as ink being not ejected or an insufficient amount of ink being ejected.

To solve this problem, a conventional practice is to minimize the wiring resistance and increase a set voltage for the heater driving signal so as to be able to tolerate the maximum voltage drop.

With the above method of increasing the set voltage, however, since there is a limit to the voltage that the heater can withstand, the set voltage cannot simply be increased according to an increase in the number of heaters. Further, when the number of heaters to be driven simultaneously is small depending on the print data, the large set voltage applies an excess energy to the heaters, lowering the thermal efficiency and degrading the durability of the heaters.

To solve this problem, a method is known which counts the number of heaters to be driven simultaneously and controls the pulse width and voltage of the driving signal, as disclosed in Japanese Patent Application Laid Open No. 9-11504. In more detail, this method counts the number of heaters to be driven simultaneously, calculates the voltage drop based on this count, and controls the pulse width and voltage according to the calculated voltage drop. This can prevent the above-described ejection failure or faulty ejection. Because an appropriate pulse width or voltage value calculated on the basis of the number of heaters to be simultaneously driven is set, this method is advantageous in terms of thermal efficiency and the heater durability.

The voltage control in this method, however, is not practical. This is because compensating for the voltage drop requires a high-precision and fast control of voltage and applying this control to the currently known voltage control power supply not only raises cost but is technically difficult. Hence, it is a common method to control only the pulse width to compensate for that part of the bubble generating energy corresponding to the voltage drop caused by simultaneous driving.

As described above, a generally employed practice is to control the pulse width of the heater driving signal in order to solve the ejection failure problem caused by variations in wiring resistance associated with heater driving and by voltage drop due to simultaneous driving of a plurality of heaters.

The pulse width control described above, however, has a problem that the pulse width itself may become too large to match the driving frequency or that the control range of pulse width may become wide causing variations in the amount of ink ejected and the ink ejection velocity.

FIG. 1 is a graph showing a relation between a pulse width of the heater driving signal and an amount of ink ejected. This relation is obtained under the condition that the drive signal is a single rectangular pulse, that the pulse voltage is set constant, and that the pulse energy from which the amount of energy corresponding to the voltage drop is subtracted and which actually contributes to the ink ejection is made constant regardless of the pulse width. That is, the pulse energy has a constant ratio (larger than 1) in magnitude to a bubble generation critical energy whatever the pulse width, the bubble generation critical energy being a limit energy at which a bubble is created.

As shown in FIG. 1, the amount of ink ejected greatly varies in a range where the pulse width is relatively small. None of the conventional pulse width control methods described above uses this largely varying region, and the pulse width control is performed by elongating a basic pulse width and using a service range where the ink ejection amount variation is small. This makes it possible to prevent the ink ejection amount and the ink ejection speed from changing even when the pulse width is changed by the control.

When the printing head is driven at higher speed, the drive cycle or period becomes shorter and the pulse of relatively long width fails to fit in the short drive period, causing trouble to the driving of the printing head. Further, when the pulse width control is to be carried out appropriately according to a large voltage drop, the control width necessarily becomes large, with the result that the region shown in FIG. 1 where the ink ejection amount varies greatly may be included in the control range. Hence, the pulse width control using this region will cause variations in the ink ejection amount and speed, significantly degrading the quality of a printed image.

SUMMARY OF THE INVENTION

An object of the present invention is to provide an ink jet printing apparatus and an ink jet printing method which, when controlling a pulse width according to a change in heater resistance and wiring resistance in a printing head and to a change in a voltage drop caused by simultaneous driving of a plurality of heaters, can properly determine a control range of the pulse width to ensure a stable ejection of ink.

In a first aspect of the present invention, there is provided an ink jet printing apparatus using a printing head, which applies driving signal to a plurality of heaters for generating thermal energy so that ink is ejected by utilizing the thermal energy, to eject the ink to a printing medium for performing printing, the apparatus comprising:

detecting means for detecting a quantity indicating an amount of voltage drop of the driving signals that occurs when the driving signals are supplied to the plurality of heaters;

obtaining means for obtaining a conduction period for the heaters in the case that the driving signals are a form of single pulse, in accordance with the quantity detected by the detecting means; and changing means for changing the driving signals into divided signals in accordance with the conduction period obtained by the obtaining means.

In a second aspect of the present invention, there is provided an ink jet printing apparatus using a printing head, which applies driving signal to a plurality of heaters for generating thermal energy so that ink is ejected by utilizing the thermal energy, to eject the ink to a printing medium for performing printing, the apparatus comprising:

detecting means for detecting a quantity indicating an amount of voltage drop of the driving signals that occurs when the driving signals are supplied to the plurality of heaters; and control means for controlling the driving signals in accordance with the quantity detected by the detecting means so that the smaller the predetermined quantity is, the longer a pulse width of a previous pulse in divided pulses as the driving signal is.

In a third aspect of the present invention, there is provided an ink jet printing apparatus using a printing head, which applies driving signal to a plurality of heaters for generating thermal energy so that ink is ejected by utilizing the thermal energy, to eject the ink to a printing medium for performing printing, the apparatus comprising:

detecting means for detecting a quantity indicating an amount of voltage drop of the driving signals that occurs when the driving signals are supplied to the plurality of heaters; and control means for controlling the driving signals in accordance with the quantity detected by the detecting means so that the smaller the quantity is, the greater a rate of a pulse width of a previous pulse in divided pulses as the driving signal is.

In a fourth aspect of the present invention, there is provided an ink jet printing apparatus using a printing head, which applies driving signal to a plurality of heaters for generating thermal energy so that ink is ejected by utilizing the thermal energy, to eject the ink to a printing medium for performing printing, the apparatus comprising:

detecting means for, when the driving signals are supplied to the plurality of heaters, detecting a number of heaters to which the driving signals are supplied simultaneously;

obtaining means for obtaining a conduction period for the heaters in the case that the driving signals are a form of single pulse, by referring to a table with the number of heaters detected by the detecting means; and determining means for determining a waveform of a pulse as the driving signal by referring a division table with the conduction period obtained by the obtaining means.

In a fifth aspect of the present invention, there is provided an ink jet printing method of using a printing head, which applies driving signal to a plurality of heaters for generating thermal energy so that ink is ejected by utilizing the thermal energy, to eject the ink to a printing medium for performing printing, the method comprising the steps of:

detecting a quantity indicating an amount of voltage drop of the driving signals that occurs when the driving signals are supplied to the plurality of heaters;

obtaining a conduction period for the heaters in the case that the driving signals are a form of single pulse, in accordance with the quantity detected by the detecting step; and changing the driving signals into divided signals in accordance with the conduction period obtained by the obtaining step.

In a sixth aspect of the present invention, there is provided an ink jet printing method of using a printing head, which applies driving signal to a plurality of heaters for generating thermal energy so that ink is ejected by utilizing the thermal energy, to eject the ink to a printing medium for performing printing, the method comprising the steps of:

detecting a quantity indicating an amount of voltage drop of the driving signals that occurs when the driving signals are supplied to the plurality of heaters; and controlling the driving signals in accordance with the predetermined quantity detected by the detecting step so that the smaller the predetermined quantity is, the longer a pulse width of a previous pulse in divided pulses as the driving signal is.

In a seventh aspect of the present invention, there is provided an ink jet printing method of using a printing head, which applies driving signal to a plurality of heaters for generating thermal energy so that ink is ejected by utilizing the thermal energy, to eject the ink to a printing medium for performing printing, the method comprising the steps of:

detecting a quantity indicating an amount of voltage drop of the driving signals that occurs when the driving signals are supplied to the plurality of heaters; and controlling the driving signals in accordance with the quantity detected by the detecting step so that the smaller the predetermined quantity is, the greater a rate of a pulse width of a previous pulse in divided pulses as the driving signal is.

In a eighth aspect of the present invention, there is provided an ink jet printing method of using a printing head, which applies driving signal to a plurality of heaters for generating thermal energy so that ink is ejected by utilizing the thermal energy, to eject the ink to a printing medium for performing printing, the method comprising the steps of:

when the driving signals are supplied to the plurality of heaters, detecting a number of heaters to which the driving signals are supplied simultaneously;

obtaining a conduction period for the heaters in the case that the driving signals are a form of single pulse, by referring to a table with the number of heaters detected by the detecting step; and determining a waveform of a pulse as the driving signal by referring a division table with the conduction period obtained by the obtaining step.

With the construction above, the driving signal is changed from a single pulse to a double pulse or a desired pulse waveform is determined, according to a predetermined amount indicating an amount of voltage drop of the driving signal that occurs when the drive signal is supplied to a plurality of heaters. This enables the heaters to be driven with a double pulse or a changed waveform pulse of the driving signal if the heaters are driven with a single pulse, a pulse width, or conduction time, of which is in a range that varies the ink ejection amount. It is therefore possible to eject ink with the drive signal that does not cause variations in the ink ejection amount.

The above and other objects, effects, features and advantages of the present invention will become more apparent from the following description of embodiments thereof taken in conjunction with the accompanying drawings.

BRIEF DESCRIPTION OF THE DRAWINGS

FIG. 11 is a diagram schematically showing a simultaneous drive bit-driving pulse table according to the first embodiment;

FIG. 12 is a diagram schematically showing a driving pulse width division table according to the first embodiment and a second embodiment;

FIG. 15 is a diagram schematically showing a heater resistance-driving pulse table according to the second embodiment.

DETAILED DESCRIPTION OF PREFERRED EMBODIMENTS

Now, embodiments of the present invention will be described in detail by referring to the accompanying drawings.

Figure 2:
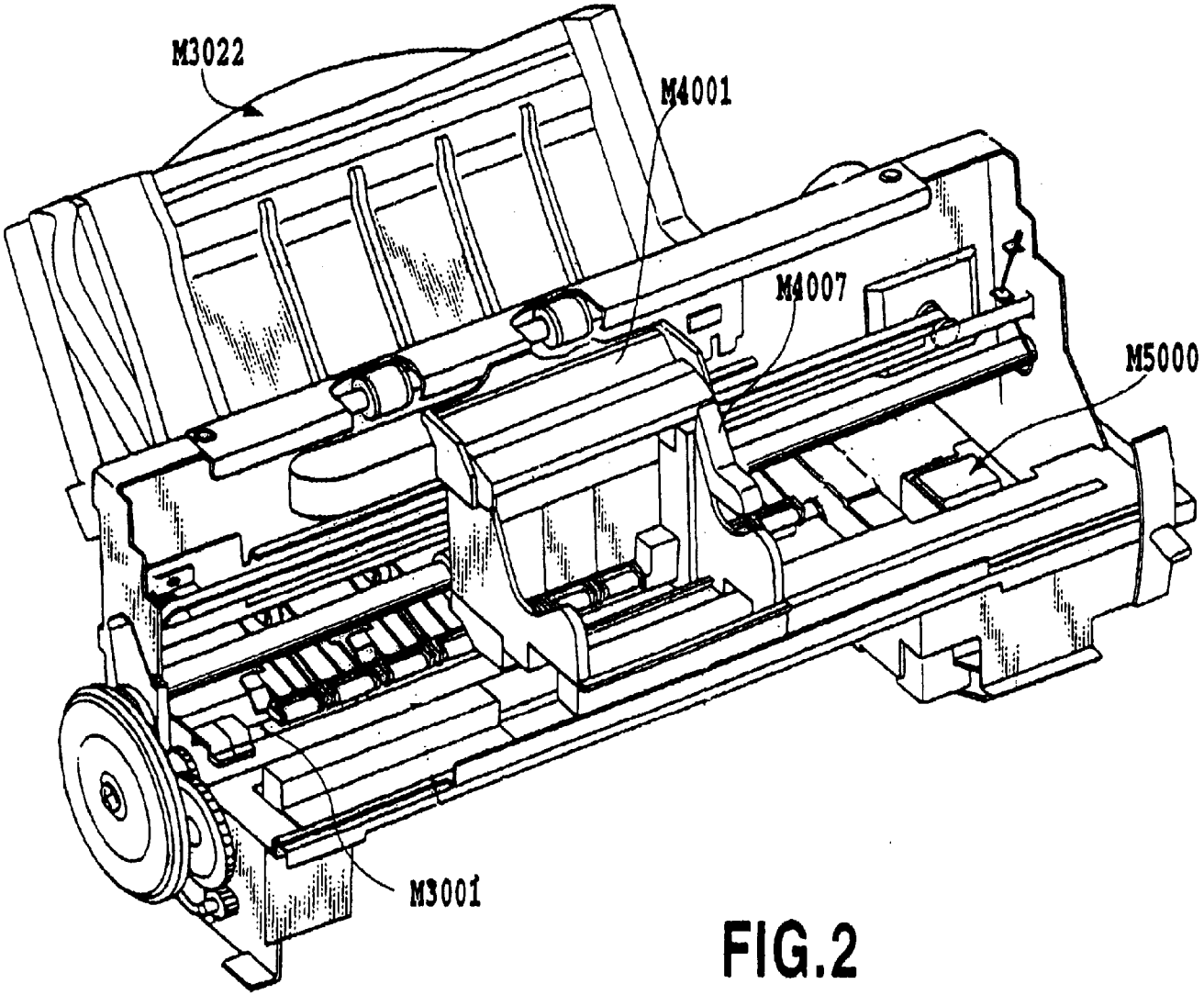
FIG. 2 is a perspective view showing a mechanism portion of an ink jet printer according to one embodiment of this invention.

FIG. 2 is a perspective view showing the main construction of an ink jet printer according to one embodiment of the present invention.

Figure 3:
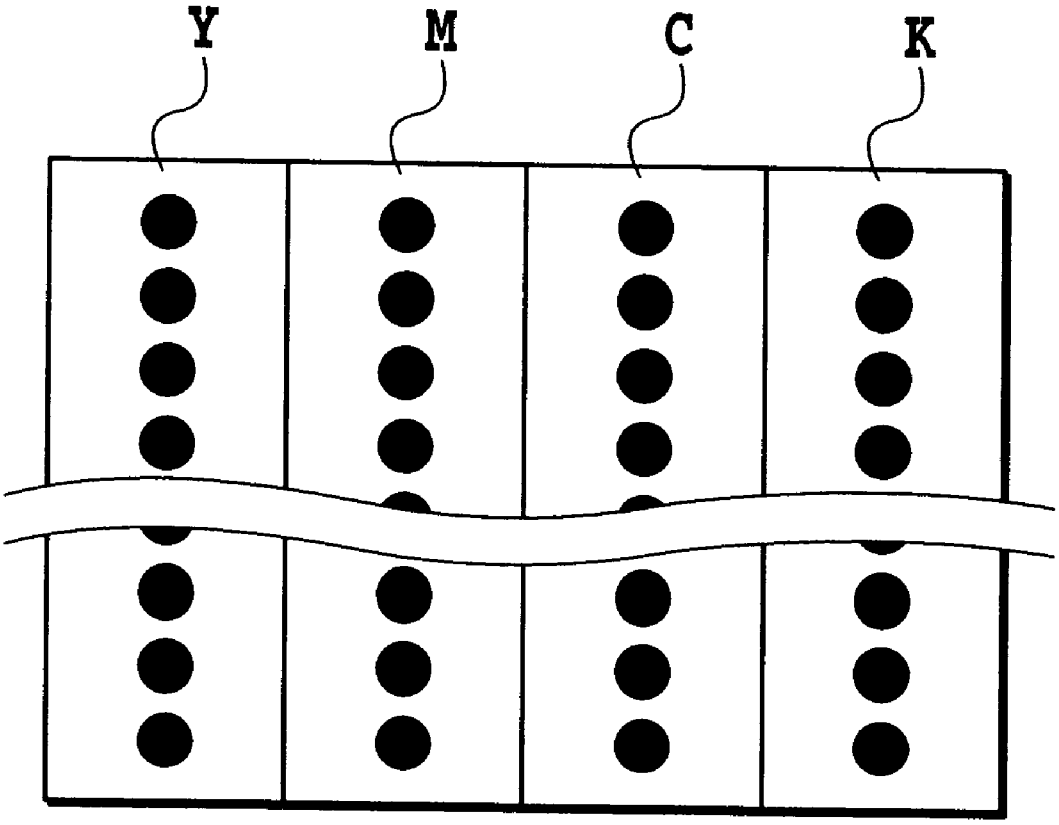
FIG. 3 is an elevation view showing nozzle arrays of the printing heads used in the printer.

The printer of this embodiment uses four printing heads that eject black (K), cyan (C), magenta (M) and yellow (Y) inks, respectively. These printing heads and their ink tanks are of a cartridge type, as described later with reference to FIGS. 4 and 5, and are removably mounted on a carriage M4001. FIG. 2 shows the construction in which the cartridge made up of the printing heads and ink tanks is removed. Each of the printing heads, as shown in FIG. 3, has 384 nozzles and a nozzle arrangement density of 360 dpi.

The printing heads are mounted on the carriage M4001 together with the ink tanks. As the carriage M4001 is driven by a carriage motor (not shown) along a guide shaft, the printing heads scans over a printing paper (not shown) to eject ink onto the printing paper according to print data. In more detail, the carriage M4001 located at a home position before the start of printing operation is moved toward the right in the figure (in the direction of forward scan) when it receives a print start command. At the same time, each of the printing heads ejects ink from its nozzles according to the print data onto the printing paper to performing printing of a width corresponding to a range at which nozzles are arranged. The ink is ejected from each printing head by driving the heaters provided in one-to-one correspondence with the nozzles at timings corresponding to position detection signals of an encoder that detects a position of the moving carriage. When the printing is done up to the end of a predetermined print area on the paper, the carriage M4001 returns to the home position and repeats the forward scan for printing. In the case of a reciprocal or forward/backward scan printing, the printing heads perform the similar printing operation also during a backward scan, which is opposite to the forward scan. Between these scans, a paper feed roller M3001 is rotated a predetermined amount to feed the paper by a predetermined distance equal to the width of printing. With scanning of the printing head and the paper feed being performed repetitively in this manner, a predetermined image is printed on the paper.

Denoted M3001 is a paper feed roller which feeds the printing paper supplied from an automatic paper feeder M3022 by an amount equal to the width of printing by the scanning of the printing heads.

When the printing is not performed or when an ejection performance recovery operation is carried out, the carriage M4001 moves to the home position at the right end in the figure where the printing heads stand by for the next printing operation or undergo an ejection performance recovery operation by a recovery unit M5000.

Figure 4:
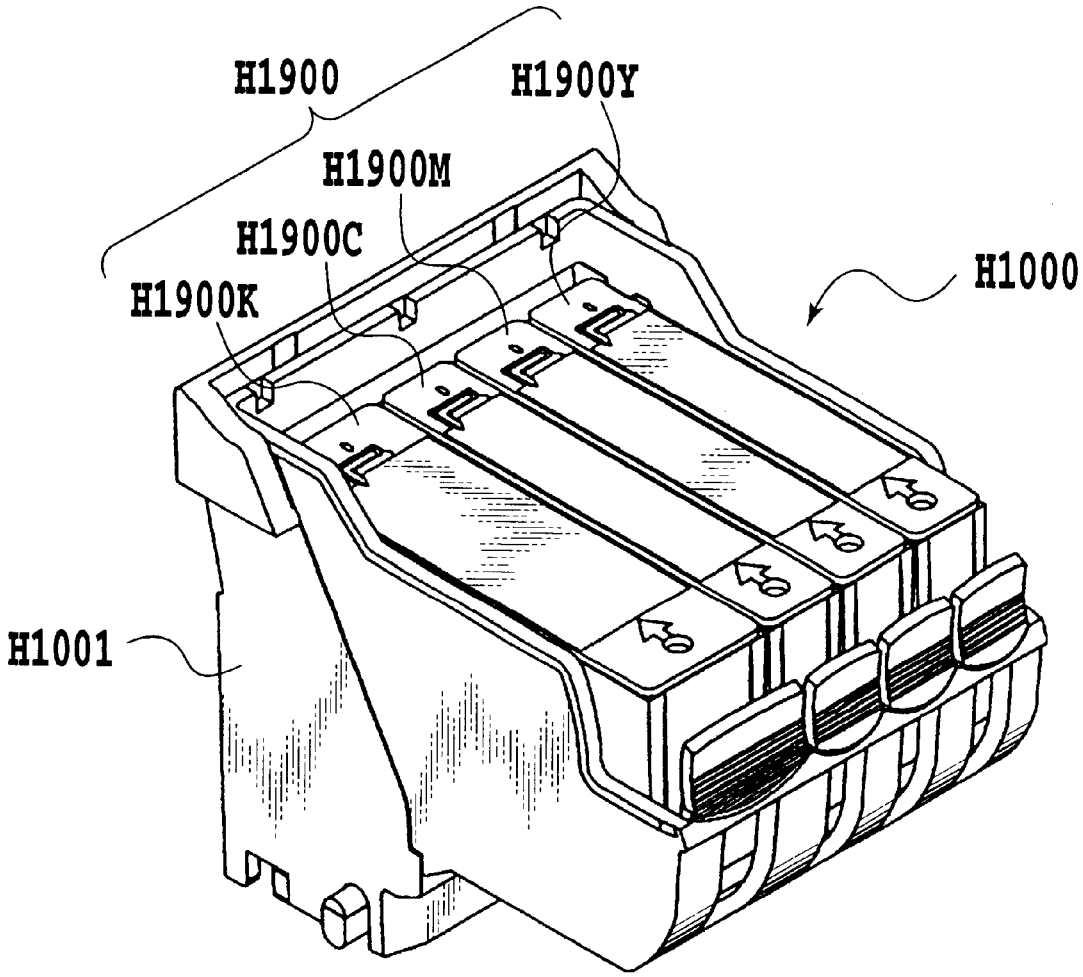
FIG. 4 is a perspective view showing a printing head cartridge used in the printer.
Figure 5:
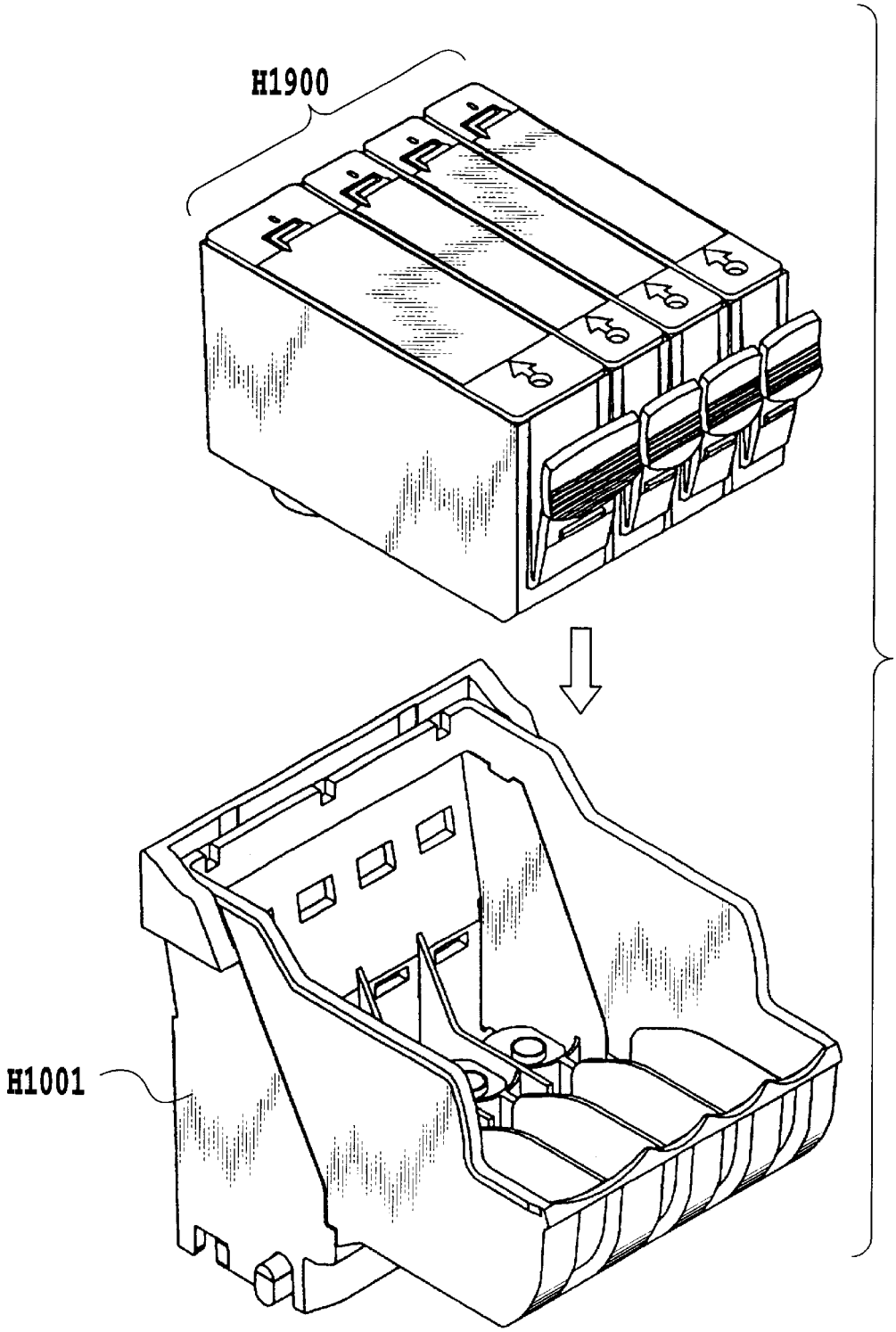
FIG. 5 is a perspective view showing the printing heads and ink tanks separated from each other which together form the printing head cartridge.

FIG. 4 is a perspective view showing the printing head cartridge used in the ink jet printer of the embodiment shown in FIG. 2. FIG. 5 is a perspective view showing the printing heads and the ink tanks, which together form the head cartridge, separated from each other.

As shown in these figures, the printing head cartridge H1000 comprises printing heads H1001 and ink tanks H1900 (H1900K, H1900C, H1900M, H1900Y) removably attached to the printing heads. That is, an ink tank H1900K contains a black ink, an ink tank H1900C a cyan ink, an ink tank H1900M a magenta ink, and an ink tank H1900Y a yellow ink. These ink tanks H1900K, H1900C, H1900M and H1900Y are individually removably mounted to the printing heads H1001 so that these ink tanks can be replaced individually. This construction reduces a running cost of printing by the printer.

The printing heads H1001 have an integral mounting portion on which the ink tanks H1900 are mounted. The printing heads H1001 have a nozzle surface, which faces downwards in these figures and is formed with arrays of nozzles as shown in FIG. 3.

The printing head cartridge H1000 is removably mounted on the carriage M4001 of the ink jet printer of FIG. 2. When it is mounted, the head set lever M4007 (see FIG. 2) provided on the carriage M4001 is operated so as to fix and position the printing head cartridge H1000 to a mount position. This mounting operation also causes an electric contact board of the printing head cartridge H1000 and an electric contact board of the carriage M4001 to be connected and secured together.

Figure 6:
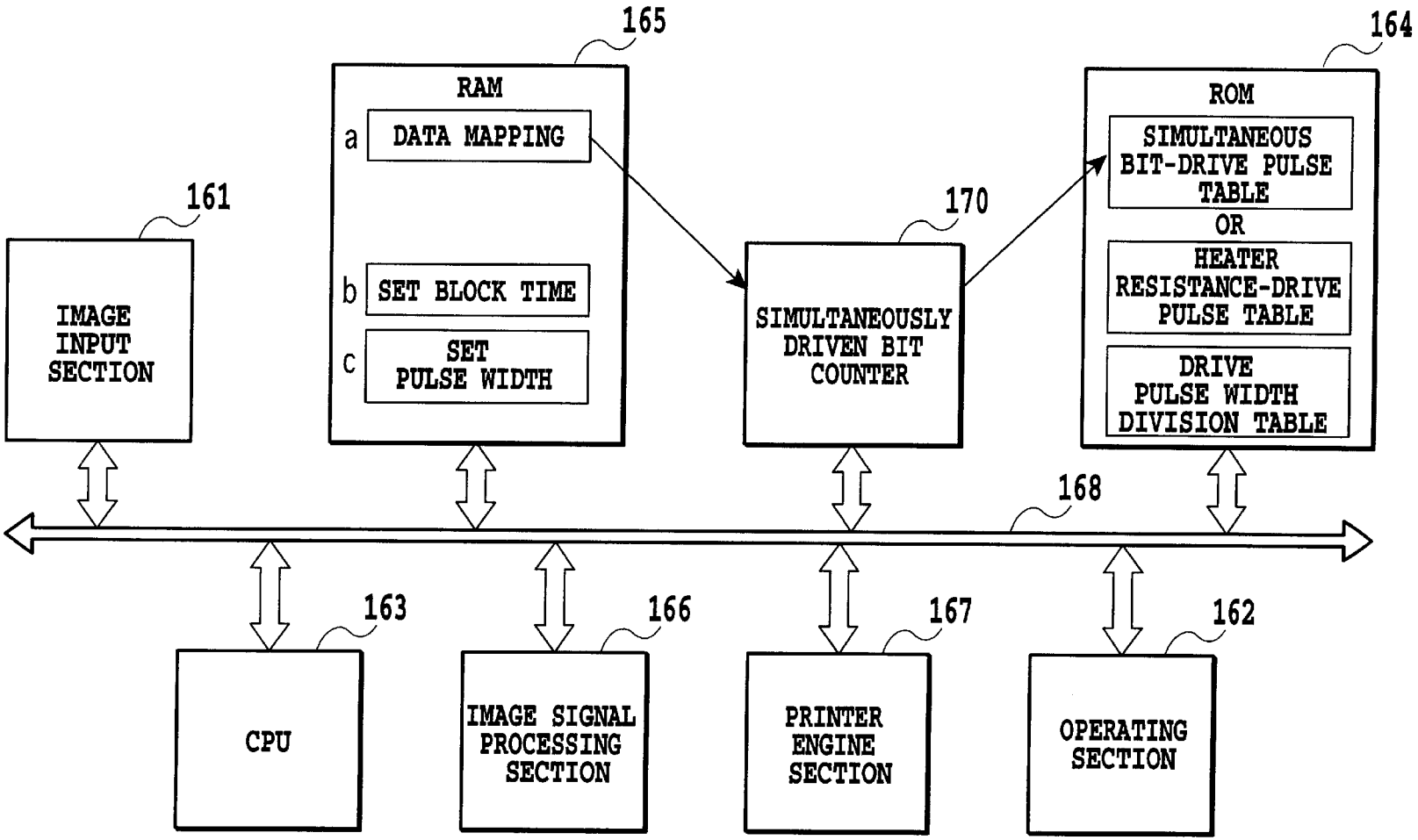
FIG. 6 is a block diagram showing a configuration of a control system of the printer according to the embodiment.

FIG. 6 is a block diagram showing a configuration of a control system in the ink jet printer of this embodiment and more particularly a control configuration of a driving signal used for driving the printing heads.

In the figure, an image input section 161 receives an image signal from a host computer or video device or an image signal read by a scanner having CCDs and inputs as luminance signals R, G, B. An operation section 162 has various keys for an operator to set parameters and issue a command for starting the printing operation or the like.

A CPU 163 executes an overall control of the printer, which includes processing associated with the driving signal control in this embodiment that will be described with reference to FIG. 10, according to a variety of programs stored in a ROM 164. The ROM 164 stores programs for executing operations and processing performed in the printer and, as shown in the figure, includes a simultaneous driving bit-block time table associated with a first embodiment of the present invention regarding the driving signal control described later, a heater resistance drive pulse table associated with a second embodiment, and a drive pulse width division table used in both of these embodiments. A simultaneous driving bit counter 170 is a counter used in the first embodiment to count the number of simultaneous driving bits from the print data mapped in a print data mapping area a of a RAM 165. Based on this counter value, the CPU 163 refers to the simultaneous bit-driving pulse table. The RAM 165 has a print data mapping area a described above, a set block time storage area b and a set pulse width storage area c, and also a work area used by the CPU 163 in executing processing.

An image signal processing section 166 processes image signals under the control of the CPU 163, as detailed later. A printer engine section 167 is a printing mechanism, whose outline is shown in FIG. 2, and forms an image of ink dots according to the print data obtained as a result of processing by the image signal processing section 166. A bus line 168 transmits an address signal, data, and a control signal used in this control configuration.

Figure 7:
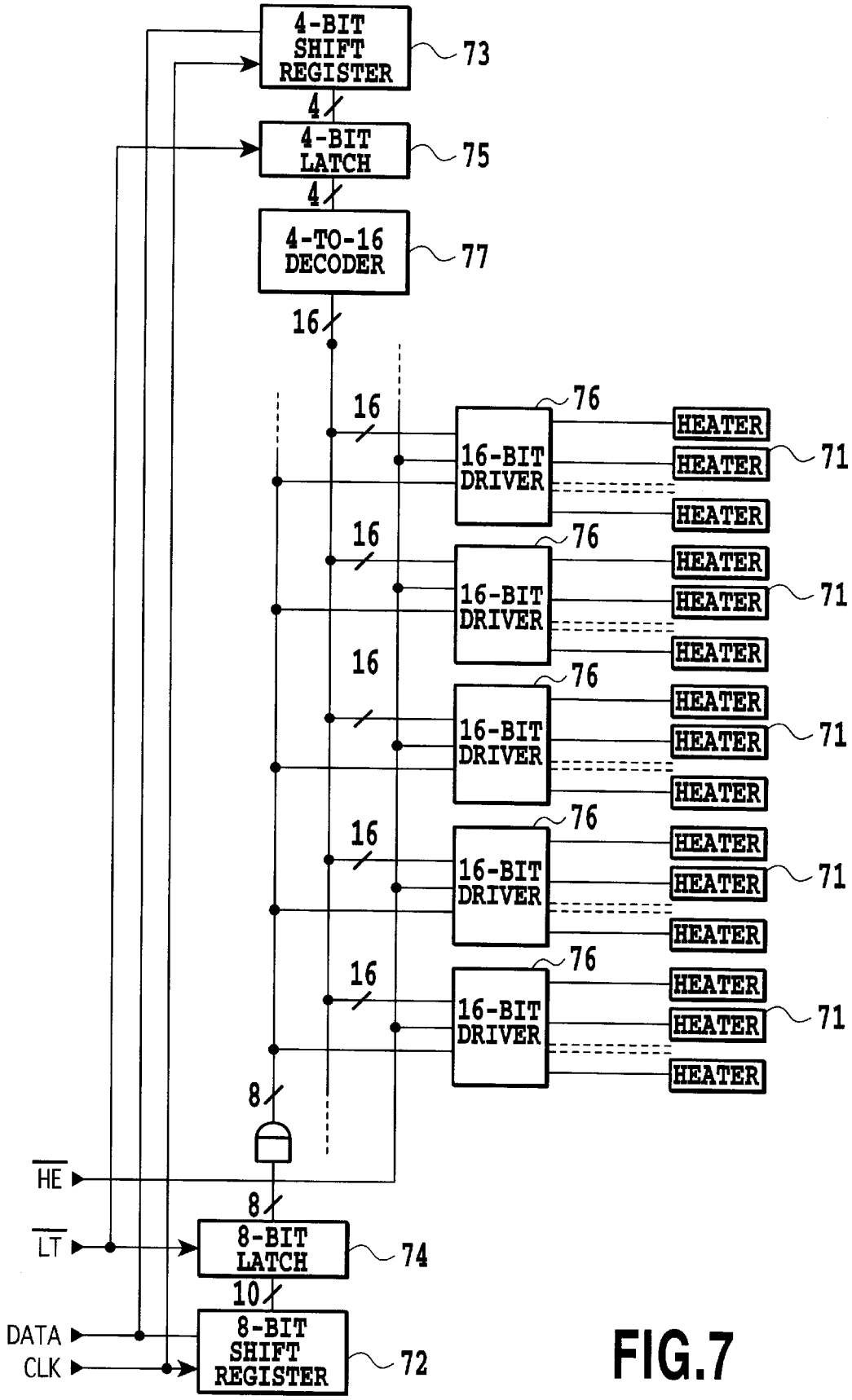
FIG. 7 is a circuit diagram of a printing head driving circuit in the printer.

FIG. 7 is a circuit diagram showing a configuration of a head driving circuit formed in the printing heads of this embodiment.

Each of the printing heads of the embodiment has three sets of the circuit shown in the figure and 384 electrothermal transducers (heaters) 71 are divided into 16 blocks each having 24 heaters (8 heaters×3 sets). These heaters are driven for each block on a time-division basis. More specifically, in this embodiment, each set of the circuit has eight drivers 76 one for each bit of 8-bit print data output from a latch 74. Each of the eight drivers 76 selects, according to 16 block enable signals output from a decoder 77, a heater in a block represented by the block enable signal from eight heaters for each driver. The detail of the operation of this circuit will be explained by referring to the timing charts of FIGS. 8 and 9.

Figure 8:
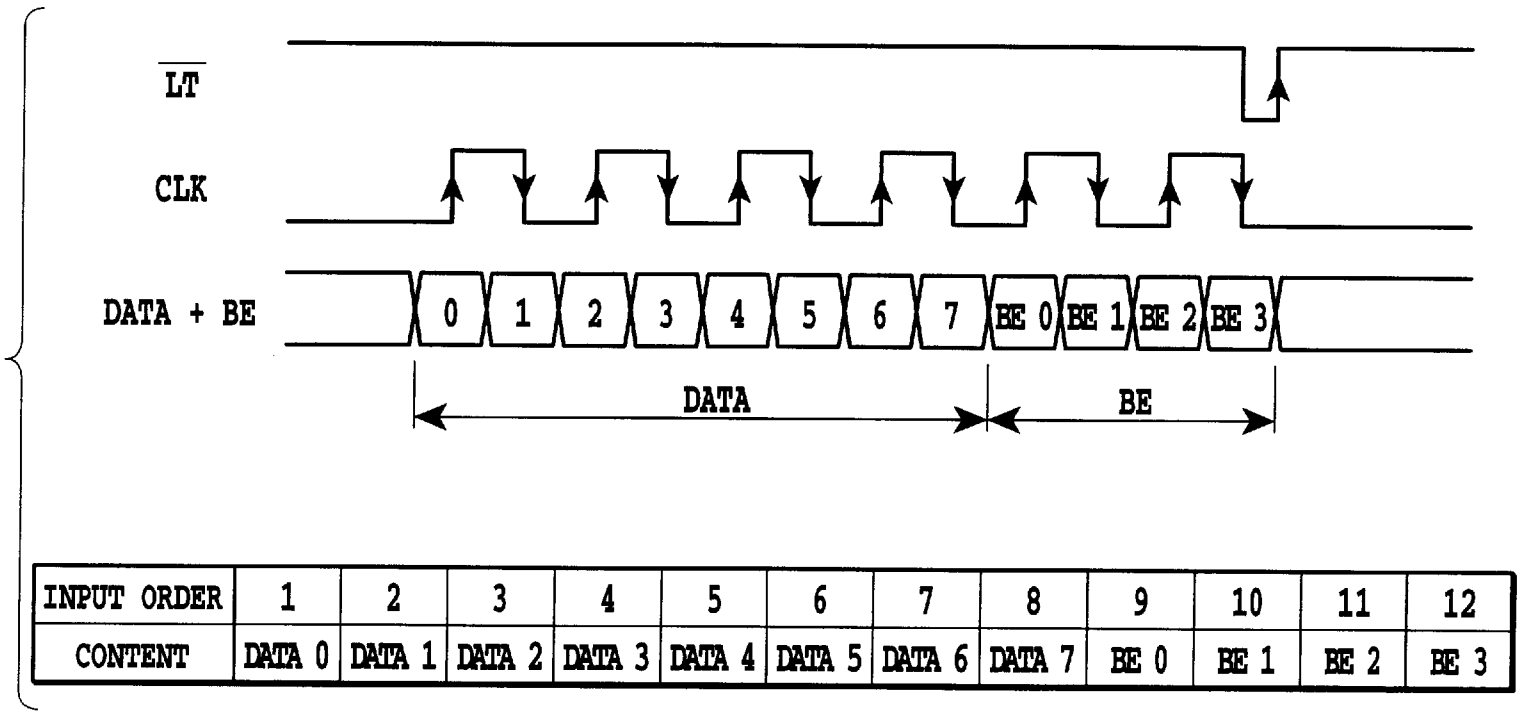
FIG. 8 is a timing chart of various data in the printing head driving circuit for one block.

FIG. 8 is a timing chart for one set of the circuit showing a timing of transferring print data of one block and data representing a block to be driven.

As shown in the figure, at the edge timing of a clock signal CLK input to a CLK terminal (FIG. 7), a signal DATA+BE is entered into a DATA terminal (FIG. 7). Of the signal DATA+BE, print data DATA0-7 that are entered in the input order of 1 to 8 as shown in the table of FIG. 8 are print data that represent on or off of each heater and are successively stored in an 8-bit shift register 72 (FIG. 7). Block selection data BEO-3 that are entered in the input order of 9 to 12 in the same table of FIG. 8 are combined and decoded to select a block to be driven and are successively stored in a 4-bit shift register 73 (FIG. 7), as will explained with reference to FIG. 9.

After the print data and the block selection data for one block have been transferred, the data in the shift register 72 and the shift register 73 are latched by an 8-bit latch 74 and a 4-bit latch 75 respectively at a leading ledge of a latch signal LT input through an LT terminal (FIG. 7).

Figure 9:
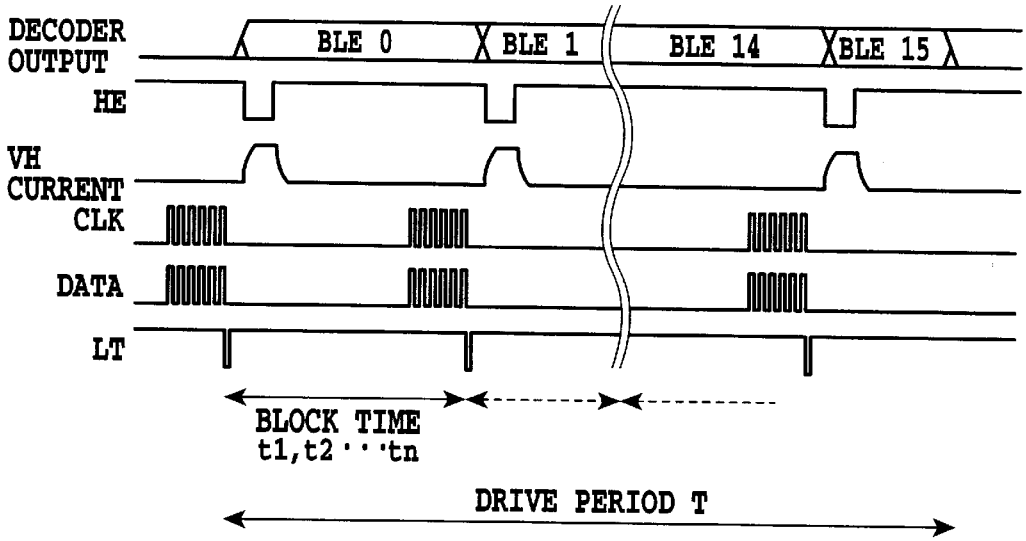
FIG. 9 is a timing chart of various data in the printing head driving circuit for each block in one nozzle column.

FIG. 9 is a timing chart for driving heaters of one column, which corresponds heaters of one nozzle array in the printing head. More specifically, after the first one block of data has been transferred as explained in FIG. 8, data transfer and heater driving are performed simultaneously. FIG. 9 represents a timing chart for 16 blocks or one driving cycle for this data transfer and heater driving.

In FIG. 9, the block selection data latched by the 4-bit latch 75 according to the latch signal LT is entered into the decoder 77 (FIG. 7) and then is decoded and output as one of sixteen 16-bit block enable data BLE0-15, as shown in the table of FIG. 9. More specifically, as shown in the table of FIG. 9, the combination of contents L (0) or H (1) of the block selection data BE0-3 successively changes at each transfer of one block and, according to this change, a block that can be driven (for which the block enable data BLE is high) is selected successively. Following the latch signal LT, a heat enable signal HE is entered from an HE terminal (FIG. 7). Here, the heat enable signal HE is low-active.

Then, in the circuit shown in FIG. 7, the HE terminal is connected to all the drivers. Further, all signal lines of the block enable data BLE0-15 are each connected to the one of eight drivers 76 each corresponding to sixteen heaters 71. On the other hand, eight signal lines from the 8-bit latch 74 are connected to the associated drivers among the 8 drivers 76, respectively. This forms a matrix of print data and block enable data BLE, making it possible to driving the 128×3 sets of heaters in a manner of block driving.

To be described in more detail, the heat enable signal HE sets a pulse width of the heater driving signal. The print data DATA and the heat enable signal HE are entered to all of sixteen AND circuits (not shown) provided in one-to-one correspondence with the sixteen heaters for each driver 76. The block enable signals BLE are entered to the associated AND circuits out of the sixteen AND circuits, respectively. When the print data DATA and the heat enable signal HE and the block enable signals BLE are all on (H), a current VH shown in FIG. 9 flows in corresponding heaters 71. Because the block enable signals BLEO–BLE15 are successively transferred for each block, the heaters of respective blocks are sequentially driven according to the print data for each block. As a result, 128×3 set of heaters for one column are driven within a period of one driving cycle T. The similar operation is repeated to drive heaters for each one column in synchronism with the scanning of the printing head.

Embodiment 1

Next, the driving signal control in the ink jet printer described above according to the first embodiment of the present invention will be explained.

Figure 10:
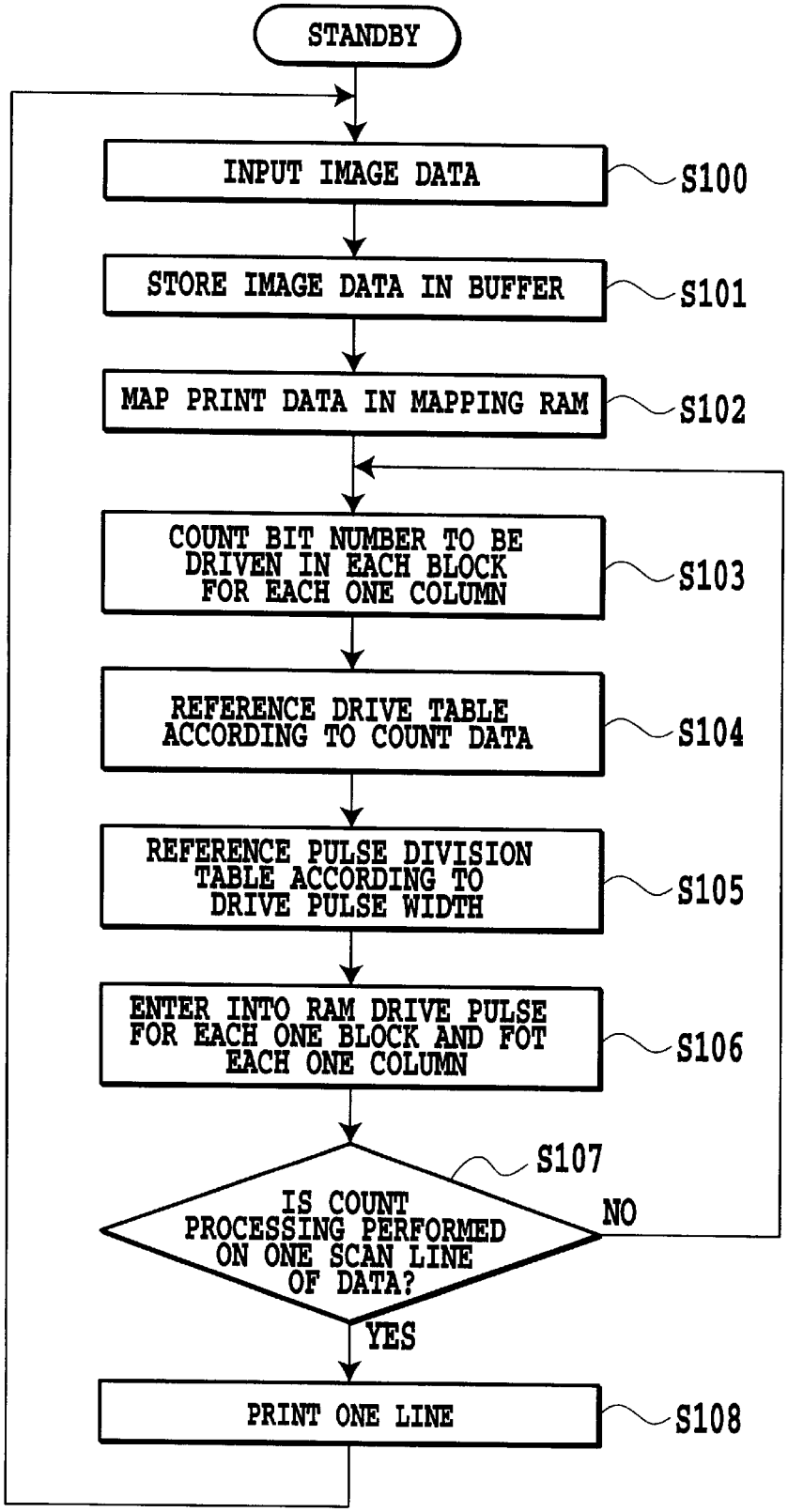
FIG. 10 is a flow chart showing a procedure for controlling a pulse waveform of a driving signal according to a first embodiment of the present invention.

FIG. 10 is a control flow chart for a printing operation. Further, FIG. 11 shows a simultaneous bit-driving pulse table in the ROM 164 of FIG. 6 and FIG. 12 shows a drive pulse width division table in the ROM 164 of FIG. 6.

The control for the printing operation starts from the printing standby state, at first step S100 takes image data through the image input section 161 and step S101 temporarily stores the data in a data buffer of the image signal processing section 166. Then, the image processing section performs predetermined processing at a predetermined timing, such as brightness-density conversion and masking, and finally performs digitization processing to produce binary print data. At step S102 the print data is mapped in the data mapping area a in the RAM 165.

Next, at step S103 the simultaneous drive bit counter 170 counts, in the print data mapped in the data mapping area a, the number of heaters (in this specification, this is also referred to as "bit number") to be driven simultaneously in each block for one column. Then, Step S104 refers to the simultaneous bit-driving pulse table of ROM 164 shown in FIG. 11 and determines a pulse width of the driving signal for each block.

In this embodiment, as explained with reference to FIG. 7, the number of heaters to be simultaneously driven for each block will be somewhere in a 0- to 24 bit range according to the print data. When the simultaneous drive number is 0 to 3, the pulse width is determined to be 1.6 μs; when the simultaneous drive number is 4–7, the pulse width is determined to be 1.8 μs; and so on as shown in the simultaneous bit-driving pulse table of FIG. 11.

Figure 1:
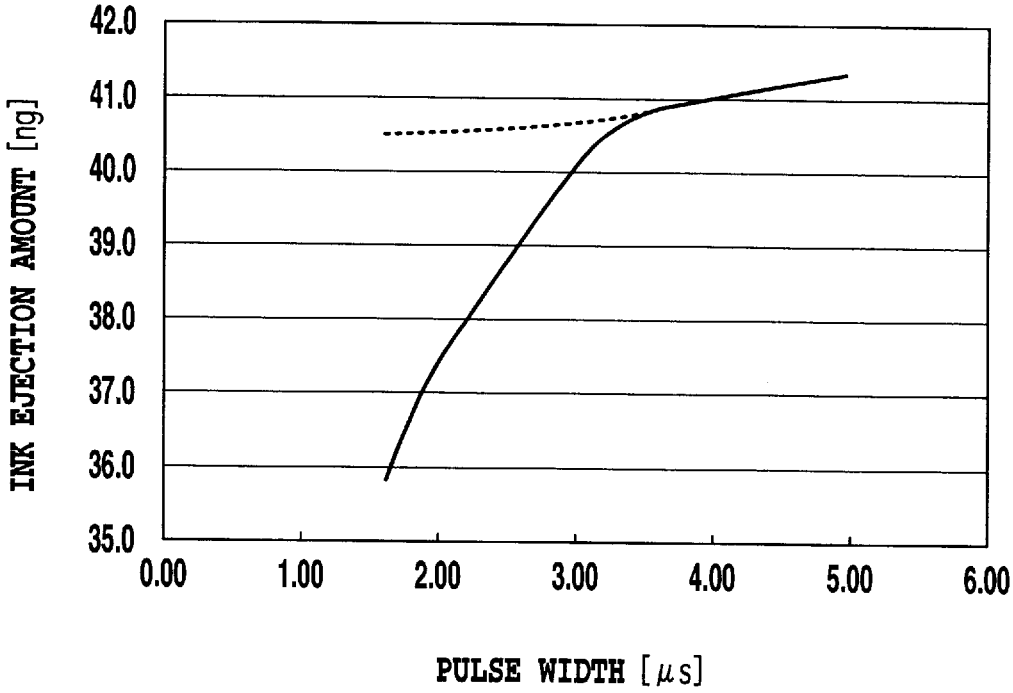
FIG. 1 is a graph showing a relationship between a pulse width of a printing head driving signal and an amount of ink ejected.

The pulse width here refers to a pulse width, that is, conduction time when the heater driving signal is a single rectangular voltage pulse with a predetermined voltage value of $V_H$. As described earlier with reference to FIG. 1, when such a single pulse is used to drive the heaters, the amount of ink ejected greatly varies in a range where the pulse width is short. Hence, in such an ink ejection amount varying region, i.e., in a range where the conduction time is 1.6–3.6 μs, the drive signal is changed to a so-called a double pulse, as described below, to prevent variations in the ink ejection amount. It should be noted that the total energy of the double pulse obtained from the table of this embodiment and the energy of the corresponding basic single pulse are equal to each other for any pulse width. Further, as described above, the energies of pulses that contribute to the actual ink ejection are also equal for any pulse width and have a constant ratio in magnitude with respect to the critical bubble generation energy. In that case, the voltage values of the single pulse and the double pulse are also equal and constant.

After the table has been referenced as described above, step S105 refers to the drive pulse width division table in the ROM 164 of FIG. 12 for each block with the pulse width determined as described above and sets a drive signal waveform for each block. In this embodiment, a so-called double pulse waveform in which a single pulse is divided in two is used as the drive signal waveform, and the pulse widths of the divided pulses are changed to generate a waveform different from that of the single pulse.

Figure 13:
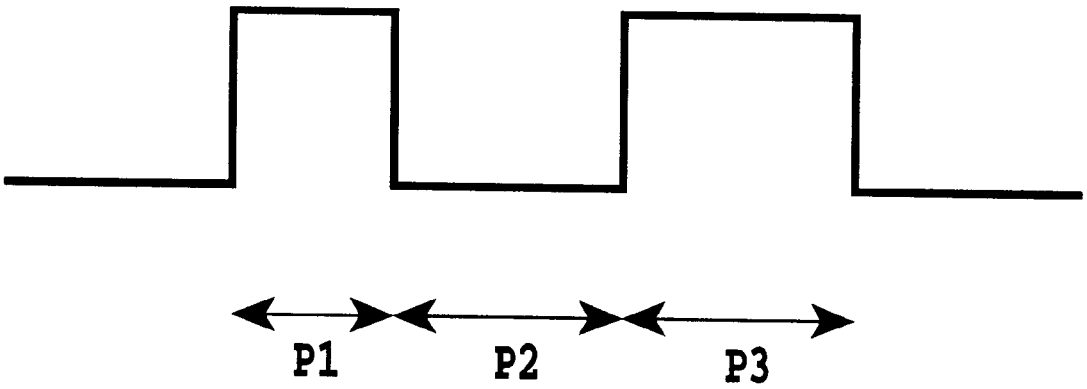
FIG. 13 is a diagram showing a waveform and used to explain a pulse width of a double pulse according to the first embodiment and second embodiment.

P1, P2 and P3 in FIG. 12 refer to widths of two divided pulses and pause time between the two pulses, as shown in FIG. 13. While this embodiment uses two rectangular pulses, it is possible to use three or more rectangular pulses or other forms of pulses than rectangular ones. As described above, a multi-pulse consisting of a plurality of pulses includes at least one pre-pulse (previous pulse) for heating that does not generate a bubble in ink, a main pulse that generates a bubble, and a pause period between the pulses. On the other hand, the single pulse consists of one pulse that generates a bubble for ejecting ink.

As shown in the drive pulse division table of FIG. 12, when the pulse width is 1.6 μs, P1 (pre-pulse)=0.7 μs, P2 (pause period)=0.9 μs and P3 (main pulse)=0.9 μs; when the pulse width is 1.8 μs, P1 (pre-pulse)=0.5 μs, P2 (pause period)=0.8 μs and P3 (main pulse)=1.3 μs; when the pulse width is 2.0 μs, P1 (pre-pulse)=0.4 μs, P2 (pause period)=0.7 μs and P3 (main pulse)=1.6 μs; when the pulse width is 2.5 μs, P1 (pre-pulse)=0.3 μs, P2 (pause period)=0.6 μs and P3 (main pulse)=2.2 μs; when the pulse width is 3.0 μs, P1 (pre-pulse)=0.2 μs, P2 (pause period)=0.5 μs and P3 (main pulse)=2.8 μs; and when the pulse width is 3.6 μs, P1 (pre-pulse)=0.0 μs, P2 (pause period)=0.0 μs and P3 (main pulse)=3.6 μs. The pulse width of the driving signal is set for each block in this way. It is seen from the above that the driving signal is a double pulse (multi-pulse) when the pulse width determined from the simultaneous drive bit number is 3.0 μs or less, with the waveform changed by changing the pre-pulse width, the pause period and the main pulse width. When the pulse width is 3.6 μs, the component pulse widths are changed to form a single pulse. This can also be considered to be a double pulse with the pre-pulse width and the pause period set to 0 μs.

A relation between the number of simultaneous driven bit and the divided pulses is derived from the above description with respect to two tables shown in FIGS. 11 and 12, as follows. The smaller the number of simultaneous driven bit is, the longer the pre-pulse width is. Also, the smaller the number of simultaneous driven bit is, the greater the rate of the pre-pulse width in a pulse width, which is obtained by adding the pre-pulse width and the main pulse (the conduction time when the heater driving signal is the single pulse), is. This relation enables the ink ejection to be stable even if determining of the pulse width of the driving signal is performed in a narrow range of the pulse width.

After the waveform is set as described above, step S106 writes into the set pulse width area c of the RAM 165 the pulse width of the driving signal set for each block in one column. Then, step S107 checks if the count for the one scan line of print data has been completed and if the pulse waveform setting processing based on that count is completed. If the processing on the one scan line of data is completed, the heat enable signal HE (FIG. 9) is generated based on the set pulse width stored in the set pulse width area c of the RAM 165, i.e., the set double pulse data. Then, Step S108 performs printing of the one scan line with scanning of the printing head.

As described above, with this embodiment, a single pulse determined based on the simultaneous driving bit number for each one block is changed into a double pulse to prevent problems experienced with the single pulse, such as the pulse control range becoming too large to deal with the simultaneous driving bit number properly and the pulse width obtained by the pulse width control entering the ejection instability region.

Embodiment 2

Figure 14:
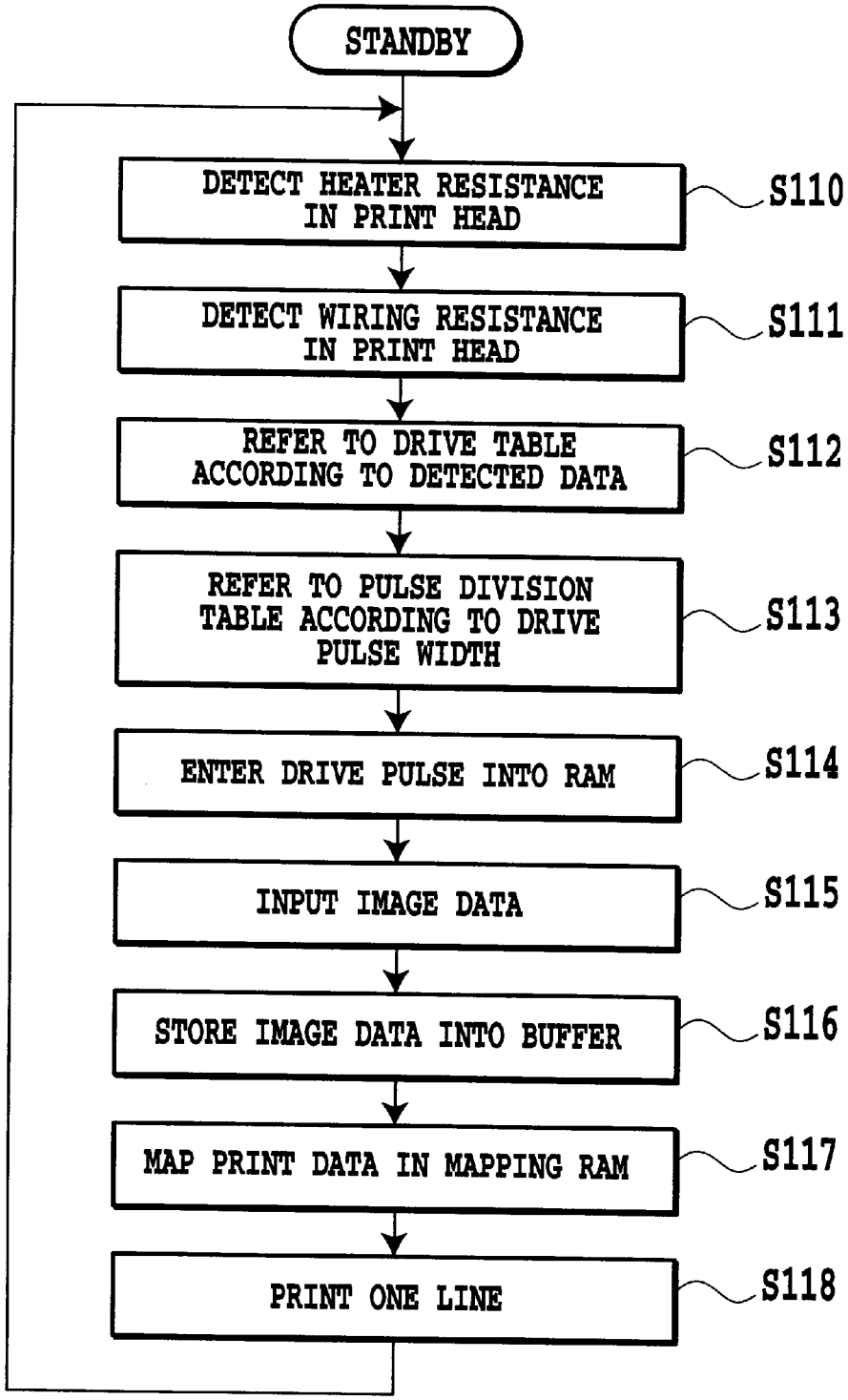
FIG. 14 is a flow chart showing a procedure for controlling a pulse waveform of a driving signal according to the second embodiment.

FIG. 14 is a flow chart showing a procedure for controlling a driving signal waveform according to the second embodiment of the present invention.

When the printing head is mounted, step S110 detects a heater resistance of the mounted printing head for each block and step S111 similarly detects a wiring resistance of the printing head for each block. In this embodiment, these resistances are previously written in a EEPROM provided in the printing head and the detecting the resistances are performed by reading them from the EEPROM.

Based on the total resistance thus detected, step S112 references the heater resistance-driving pulse table stored in the ROM 164 of FIG. 15 and determines a pulse width of the driving signal for each block in the column.

In this embodiment, the total resistance is between 80 Ω and 139 Ω. As shown in the heater resistance-driving pulse table of FIG. 15, the pulse width is determined according to the total resistance. For example, when the total resistance is 80–89 Ω, the pulse width is set to 1.6 μs; and when the total resistance is 89–99 Ω, the pulse width is set to 1.8 μs.

Next, based on the pulse width determined above, step S113 references the drive pulse width division table of FIG. 12, as in the first embodiment, to determine a double pulse as the driving signal for each block.

Then, step S114 writes the double pulse waveform data for each block into the set pulse width area c of the RAM 165. Next, as in step S100–S102 in the embodiment 1, step S115 takes in image data through the image input section 161 and step S116 temporarily stores the image data in a data buffer of the image signal processing section 166. Then, the image processing section performs predetermined image processing at a predetermined timing, such as brightness-density conversion and masking, and finally performs digitization processing to produce binary print data. Then, step S117 maps the print data in the data mapping area a in the RAM 165. This is followed by step S118 performing printing of one scan line according to the pulse width stored in the pulse width area c of the RAM 165.

This embodiment, too, can perform a stable ink ejection as does the first embodiment. This embodiment may be combined with the invention of Japanese Patent Application Laid Open No. 9-11504 to implement a configuration in which the number of heaters to be driven simultaneously is counted and the pulse width of the driving signal is determined and then changed as required.

Apparently from above description, with the embodiments of the present invention, the driving signal is changed from a single pulse to a double pulse or a desired pulse waveform is determined, according to a predetermined quantity indicating an amount of voltage drop of the driving signal that occurs when the driving signal is supplied to a plurality of heaters. This enables the heaters to be driven with a double pulse or a changed waveform pulse of the driving signal if the heaters are driven with a single pulse, a pulse width, or conduction time, of which is in a range that varies the ink ejection amount. It is therefore possible to eject ink with the drive signal that does not cause variations in the ink ejection amount.

As a result, when a plurality of heaters in the printing head are to be driven simultaneously and the pulse width is controlled according to a change in the predetermined quantity such as a voltage drop relating to the number of driven heaters, a stable ink ejection can be performed by appropriately determining the control range of the pulse width.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus using a printing head, which applies a driving signal to a plurality of heaters, said apparatus comprising:

detecting means for detecting a quantity indicating an amount of voltage drop of the driving signals that occurs when said driving signals are supplied to the plurality of heaters;

obtaining means for obtaining a conduction period for the heaters in the case that the driving signals are a form of single pulse, in accordance with the quantity detected by said detecting means; and generating means for generating divided signals as the driving signals in accordance with the conduction period obtained by said obtaining means.

2. An ink jet printing apparatus as claimed in claim 1, wherein the quantity detected by said detecting means is a number of heaters to which the driving signals are supplied simultaneously.

3. An ink jet printing apparatus as claimed in claim 2, wherein the plurality of heaters in the printing head are divided into blocks, each block including a predetermined number of heaters respectively to be driven on a time division basis for each block, and the number of heaters to which the driving signals are supplied simultaneously is the number of heaters which are driven simultaneously in each block.

4. An ink jet printing apparatus as claimed in claim 1, wherein the quantity detected by said detecting means is resistance values of the heaters to which the driving signals are supplied and wiring for said heaters.

5. An ink jet printing apparatus as claimed in claim 1, wherein said generating means generates the divided signals as the driving signals in a manner that a rate of a pulse width of a previous pulse in the divided pulses is changed in accordance with the conduction period.

6. An ink jet printing apparatus as claimed in claim 5, wherein said generating means generates the divided signals as the driving signals in a manner that the shorter the conduction period is, the greater the rate is.

7. An ink jet printing apparatus as claimed in claim 1, wherein said generating means generates the divided signals as the driving signals in a manner that a pulse width of a previous pulse in the divided pulses is changed in accordance with the conduction period.

8. An ink jet printing apparatus as claimed in claim 7, wherein said generating means generates the divided signals as the driving signals in a manner that the shorter the conduction period is, the longer the pulse width of the previous pulse is.

9. An ink jet printing apparatus as claimed in claim 1, wherein said generating means generates the divided signals as the driving signals in a manner that a waveform of the double pulse is changed in accordance with the conduction period.

10. An ink jet printing apparatus using a printing head, which applies a driving signal to a plurality of heaters, said apparatus comprising:

detecting means for detecting a quantity indicating an amount of voltage drop of the driving signals that occurs when said driving signals are supplied to the plurality of heaters; and control means for controlling the driving signals in accordance with the quantity detected by said detecting means so that the smaller the predetermined quantity is, the longer a pulse width of a previous pulse in divided pulses as the driving signal is.

11. An ink jet printing apparatus as claimed in claim 10, wherein the quantity detected by said detecting means is a number of heaters to which the driving signals are supplied simultaneously.

12. An ink jet printing apparatus as claimed in claim 11, wherein the plurality of heaters in the printing head are divided into blocks, each block including a predetermined number of heaters respectively to be driven on a time division basis for each block, and the number of heaters to which the driving signals are supplied simultaneously is the number of heaters which are driven simultaneously in each block.

13. An ink jet printing apparatus as claimed in claim 10, wherein the quantity detected by said detecting means is resistance values of the heaters to which the driving signals are supplied and wiring for said heaters.

14. An ink jet printing apparatus as claimed in claim 10, wherein said control means controls the driving signals so that the longer the pulse width of the previous pulse is made, the shorter the pulse width of a main pulse in the divided pulse is made.

15. An ink jet printing apparatus using a printing head, which applies a driving signal to a plurality of heaters, said apparatus comprising:

detecting means for detecting a quantity indicating an amount of voltage drop of the driving signals that occurs when said driving signals are supplied to the plurality of heaters; and control means for controlling the driving signals in accordance with the quantity detected by said detecting means so that the smaller the quantity is, the greater a rate of a pulse width of a previous pulse in divided pulses as the driving signal is.

16. An ink jet printing apparatus as claimed in claim 15, wherein the quantity detected by said detecting means is a number of heaters to which the driving signals are supplied simultaneously.

17. An ink jet printing apparatus as claimed in claim 16, wherein the plurality of heaters in the printing head are divided into blocks, each block including a predetermined number of heaters respectively to be driven on a time division basis for each block, and the number of heaters to which the driving signals are supplied simultaneously is the number of heaters which are driven simultaneously in each block.

18. An ink jet printing apparatus as claimed in claim 15, wherein the quantity detected by said detecting means is resistance values of the heaters to which the driving signals are supplied and wiring for said heaters.

19. An ink jet printing apparatus using a printing head, which applies a driving signal to a plurality of heaters, said apparatus comprising:

detecting means for, when the driving signals are supplied to the plurality of heaters, detecting a number of heaters to which the driving signals are supplied simultaneously;

obtaining means for obtaining a conduction period for the heaters in the case that the driving signals are a form of single pulse, by referring to a table with the number of heaters detected by said detecting means; and determining means for determining a waveform of a pulse as the driving signal by referring a division table with the conduction period obtained by said obtaining means.

20. An ink jet printing method of using a printing head, which applies a driving signal to a plurality of heaters, said method comprising the steps of:

detecting a quantity indicating an amount of voltage drop of the driving signals that occurs when the driving signals are supplied to the plurality of heaters;

obtaining a conduction period for the heaters in the case that the driving signals are a form of single pulse, in accordance with the quantity detected by said detecting step; and generating divided signals as the driving signals in accordance with the conduction period obtained by said obtaining step.

21. An ink jet printing method as claimed in claim 20, wherein the predetermined quantity detected by said detecting step is a number of heaters to which the driving signals are supplied simultaneously.

22. An ink jet printing method as claimed in claim 21, wherein the plurality of heaters in the printing head are divided into blocks, each block including a predetermined number of heaters respectively to be driven on a time division basis for each block, and the number of heaters to which the driving signals are supplied simultaneously is the number of heaters which are driven simultaneously in each block.

23. An ink jet printing method as claimed in claim 20, wherein the quantity detected by said detecting step is resistance values of the heaters to which the driving signals are supplied and wiring for the heaters.

24. An ink jet printing method as claimed in claim 20, wherein said generating step generates the divided signals as the driving signals in a manner that a rate of a pulse width of a previous pulse in the divided pulses is changed in accordance with the conduction period.

25. An ink jet printing method as claimed in claim 24, wherein said generating step generates the divided signals as the driving signals in a manner that the shorter the conduction period is, the greater the rate is.

26. An ink jet printing method as claimed in claim 20, wherein said generating step generates the divided signals as the driving signals in a manner that a pulse width of a previous pulse in the divided pulses is changed in accordance with the conduction period.

27. An ink jet printing method as claimed in claim 26, wherein said generating step generates the divided signals as the driving signals in a manner that the shorter the conduction period is, the longer the pulse width of the previous pulse is.

28. An ink jet printing method as claimed in claim 20, wherein said generating step generates the divided signals as the driving signals in a manner that a waveform of the divided pulse is changed in accordance with the conduction period.

29. An ink jet printing method of using a printing head, which applies a driving signal to a plurality of heaters, said method comprising the steps of:

detecting a quantity indicating an amount of voltage drop of the driving signals that occurs when the driving signals are supplied to the plurality of heaters; and controlling the driving signals in accordance with the predetermined quantity detected by said detecting step so that the smaller the predetermined quantity is, the longer a pulse width of a previous pulse in divided pulses as the driving signal is.

30. An ink jet printing method as claimed in claim 29, wherein the quantity detected by said detecting step is a number of heaters to which the driving signals are supplied simultaneously.

31. An ink jet printing method as claimed in claim 30, wherein the plurality of heaters in the printing head are divided into blocks, each block including a predetermined number of heaters respectively to be driven on a time division basis for each block, and the number of heaters to which the driving signals are supplied simultaneously is the number of heaters which are driven simultaneously in each block.

32. An ink jet printing method as claimed in claim 29, wherein the quantity detected by said detecting step is resistance values of the heaters to which the driving signals are supplied and wiring for the heaters.

33. An ink jet printing method as claimed in claim 29, wherein said control step controls the driving signals so that the longer the pulse width of the previous pulse is made, the shorter the pulse width of a main pulse in the divided pulse is made.

34. An ink jet printing method of using a printing head, which applies a driving signal to a plurality of heaters, said method comprising the steps of:

detecting a quantity indicating an amount of voltage drop of the driving signals that occurs when the driving signals are supplied to the plurality of heaters; and controlling the driving signals in accordance with the quantity detected by said detecting step so that the smaller the predetermined quantity is, the greater a rate of a pulse width of a previous pulse in divided pulses as the driving signal is.

35. An ink jet printing method as claimed in claim 34, wherein the quantity detected by said detecting step is a number of heaters to which the driving signals are supplied simultaneously.

36. An ink jet printing method as claimed in claim 35, wherein the plurality of heaters in the printing head are divided into blocks, each block including a predetermined number of heaters respectively to be driven on a time division basis for each block, and the number of heaters to which the driving signals are supplied simultaneously is the number of heaters which are driven simultaneously in each block.

37. An ink jet printing method as claimed in claim 34, wherein the quantity detected by said detecting step is resistance values of the heaters to which the driving signals are supplied and wiring for the heaters.

38. An ink jet printing method of using a printing head, which applies a driving signal to a plurality of heaters, said method comprising the steps of:

when the driving signals are supplied to the plurality of heaters, detecting a number of heaters to which the driving signals are supplied simultaneously;

obtaining a conduction period for the heaters in the case that the driving signals are a form of single pulse, by referring to a table with the number of heaters detected by said detecting step; and determining a waveform of a pulse as the driving signal by referring a division table with the conduction period obtained by said obtaining step.

39. An ink jet printing apparatus using a printing head, which applies a driving signal to a heater, said apparatus comprising:

driving means capable of generating a single pulse or a divided pulse as the driving pulse; and control means for controlling said driving means to switch the generated driving signal from the single pulse to the divided pulse, in a range where a pulse width of generated single pulse is short and an amount of ink ejected by said short single pulse greatly varies when the driving signal of the single pulse is varied to apply the heater.

40. An ink jet printing apparatus as claimed in claim 39, wherein energy of the driving signal of the single pulse, which is varied, has a constant ratio in magnitude with respect to critical bubble generation energy.

41. An ink jet printing apparatus as claimed in claim 39, wherein said driving means generates the single pulse of a width range greater than a total pulse width of the divided pulses.

42. An ink jet printing method using a printing head, which applies a driving signal to a heater, said method comprising the following steps:

generating a single pulse or a divided pulse as the driving pulse; and controlling said generating step to switch the generated driving signal from the single pulse to the divided pulse, in a range where a pulse width of generated single pulse is short and an amount of ink ejected by the short single pulse greatly varies when the driving signal of the single pulse is varied to apply the heater.

* * * * *

UNITED STATES PATENT AND TRADEMARK OFFICE

CERTIFICATE OF CORRECTION

PATENT NO. : 6,652,055 B2
DATED : November 25, 2003
INVENTOR(S) : Masaki Oikawa

It is certified that error appears in the above-identified patent and that said Letters Patent is hereby corrected as shown below:

Drawings,
Sheet 11, Figure 11, “SIMULTANEOULY” should read -- SIMULTANEOUSLY --.
Sheet 15, Figure 15, “89~99” should read -- 90~99 --.

Column 1,
Line 11, “in ink” should read -- an ink --.

Column 2,
Line 12, “form” should read -- formed --.

Column 5,
Line 31, “a eighth” should read -- an eighth --.

Column 6,
Line61, “scans” should read -- scan --.

Column 7,
Line 1, “peforming” should read -- perform --.

Column 8,
Line 61, “as will” should read -- as will be --.

Column 9,
Line 27, “driving” should read -- drive --.

Column 10,
Line 17, “$V_{JJ}$.” should read -- $V_H$. --.

UNITED STATES PATENT AND TRADEMARK OFFICE

CERTIFICATE OF CORRECTION

PATENT NO. : 6,652,055 B2
DATED : November 25, 2003
INVENTOR(S) : Masaki Oikawa

It is certified that error appears in the above-identified patent and that said Letters Patent is hereby corrected as shown below:

Column 11,
Line 50, “a EEPROM” should read -- an EEPROM --; and
Line 51, “detecting the” should read -- detecting of the --.

Column 12,
Line 21, “from” should read -- from the --.

Signed and Sealed this

Twenty-ninth Day of June, 2004

JON W. DUDAS
*Acting Director of the United States Patent and Trademark Office*